US007819397B2

(12) United States Patent
Shelhart

(10) Patent No.: US 7,819,397 B2
(45) Date of Patent: Oct. 26, 2010

(54) MEDIA STACK SHEET FLUFFER METHOD AND APPARATUS, AND A MEDIA PROCESSING DEVICE ARRANGED WITH THE SAME

(75) Inventor: Timothy G Shelhart, West Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 204 days.

(21) Appl. No.: 12/145,867

(22) Filed: Jun. 25, 2008

(65) Prior Publication Data

US 2009/0322013 A1 Dec. 31, 2009

(51) Int. Cl.
*B65H 3/14* (2006.01)

(52) U.S. Cl. ..... 271/97

(58) Field of Classification Search ..... 271/97, 271/98

See application file for complete search history.

(56) References Cited

U.S. PATENT DOCUMENTS 5,052,675 A 10/1991 Shebata et al.
6,015,144 A * 1/2000 Yoshii et al. ..... 271/97
6,186,492 B1 2/2001 Dechau et al.
6,264,188 B1 7/2001 Taylor et al.
6,279,896 B1 8/2001 Linder et al.
6,746,011 B2 6/2004 Miller et al.
2005/0285326 A1* 12/2005 Uji et al. ..... 271/97
2006/0244199 A1 11/2006 Marasco
2007/0138733 A1* 6/2007 Gray ..... 271/18

* cited by examiner

*Primary Examiner*—Richard W Ridley
*Assistant Examiner*—Michael C McCullough
(74) *Attorney, Agent, or Firm*—Ronald E. Prass, Jr.; Prass LLP

(57) ABSTRACT

A media stack sheet media stack fluffer jet flow is provided to a first plurality of media stack sheets in a media stack. The media stack sheet media stack fluffer jet flow then is provided to a second plurality of media stack sheets in the media stack. The second plurality of media stack sheets are positioned either above or below the first plurality of media stack sheets. Also, a sequence of momentary jet flows form a media stack sheet fluffer jet flow, which is then provided to a plurality of media stack sheets in a media stack.

20 Claims, 8 Drawing Sheets

MEDIA STACK SHEET FLUFFER METHOD AND APPARATUS, AND A MEDIA PROCESSING DEVICE ARRANGED WITH THE SAME

INCORPORATION BY REFERENCE

The disclosures of the following six (6) US patent documents are hereby incorporated by reference, verbatim, and with the same effect as though the same disclosures were fully and completely set forth herein:

Eugene F, Miller et al., "Sheet separating and feeding with variable position stack edge fluffing", U.S. Pat. No. 6,746,011 B2, issued 8 Jun. 2004;

Michael J. Linder et al., "Systems and methods for dynamically setting air system pressures based on real time sheet acquisition time data", U.S. Pat. No. 6,279,896 B1, issued 28 Aug. 2001;

Thomas N. Taylor et al., "Sheet feeding apparatus having an adaptive air fluffer", U.S. Pat. No. 6,264,188 B1, issued 24 Jul. 2001;

Richard L. Dechau et al., "Adjusting air system pressures stack height and lead edge gap in high capacity feeder", U.S. Pat. No. 6,186,492 B1, issued 13 Feb. 2001;

Ahmed-Mohsen Shebata et al., "Top vacuum corrugation feeder with aerodynamic drag separation", U.S. Pat. No. 5,052,675, issued 1 Oct. 1991; and Joseph Marasco, "Guide for tab stock received in a feeder tray", US Publication No. 2006/0244199 A1, published 2 Nov. 2006.

BACKGROUND

With high speed cut sheet feeding, materials often adhere together resulting in multi-feeds and machine shutdowns. As a result, there is a need for the media stack sheet fluffer method and apparatus and a media processing device arranged with the same that are described below.

SUMMARY

In a first aspect, there is described a media stack sheet fluffer method comprising providing a plenum flow to an aperture plate that includes plural apertures, and repetitively positioning the aperture place to present a sequence of individual apertures to a fluffer jet, thereby forming a sequence of momentary jet flows to form a media stack fluffer jet flow and providing the media stack fluffer jet flow to a plurality of media stack sheets.

In another aspect, there is provided a media processing device arranged for fluffing media stack sheets in accordance with a method, the method comprising providing a plenum flow to an aperture plate that includes plural apertures, each aperture disposed at a corresponding radial distance from an included aperture plate axis, rotating the aperture plate about the aperture plate axis to present a first aperture to a fluffer jet, thereby forming a media stack fluffer jet flow, providing the resulting first media stack fluffer jet flow to sheet edges in a media stack side of an included media stack and then rotating the aperture plate to present a second aperture to the fluffer jet, thus forming a second fluffer jet flow, and providing the second media stack fluffer jet flow to sheet edges in the media stack side, where the first aperture is disposed at a first radial distance from the aperture plate axis and the second aperture is disposed at a second radial distance from the aperture plate axis and the first radial distance is not equal to the second radial distance.

In another aspect, there is provided a media stack sheet fluffer method comprising providing a plenum flow to an aperture plate that includes plural apertures, each aperture disposed at a corresponding radial distance from an included aperture plate axis, rotating the aperture plate about the aperture plate axis to present a first aperture to a fluffer jet, thereby forming a media stack fluffer jet flow, providing the resulting first media stack fluffer jet flow to sheet edges in a media stack side of an included media stack and then rotating the aperture plate to present a second aperture to the fluffer jet, thus forming a second fluffer jet flow, and providing the second media stack fluffer jet flow to sheet edges in the media stack side, where the first aperture is disposed at a first radial distance from the aperture plate axis and the second aperture is disposed at a second radial distance from the aperture plate axis and the first radial distance is not equal to the second radial distance.

In another aspect, there is provided a media processing device arranged for fluffing media stack sheets in accordance with a method, the method comprising providing a plenum flow to an aperture plate that includes plural apertures, positioning the aperture plate to present a first aperture to a fluffer jet, thereby forming a media stack fluffer jet flow, providing the resulting first media stack fluffer jet flow to sheet edges in a media stack side of an included media stack and then repositioning the aperture plate to present a second aperture to the fluffer jet, thus forming a second fluffer jet flow, and providing the second media stack fluffer jet flow to sheet edges in the media stack side, where the second media stack fluffer jet flow is positioned either above or below the first fluffer jet flow.

DETAILED DESCRIPTION

Briefly, a media stack sheet media stack fluffer jet flow is provided to a first plurality of media stack sheets in a media stack. The media stack sheet media stack fluffer jet flow then is provided to a second plurality of media stack sheets in the media stack. The second plurality of media stack sheets are positioned either above or below the first plurality of media stack sheets. Also, a sequence of momentary jet flows form a media stack sheet fluffer jet flow, which is then provided to a plurality of media stack sheets in a media stack.

Figure 1:
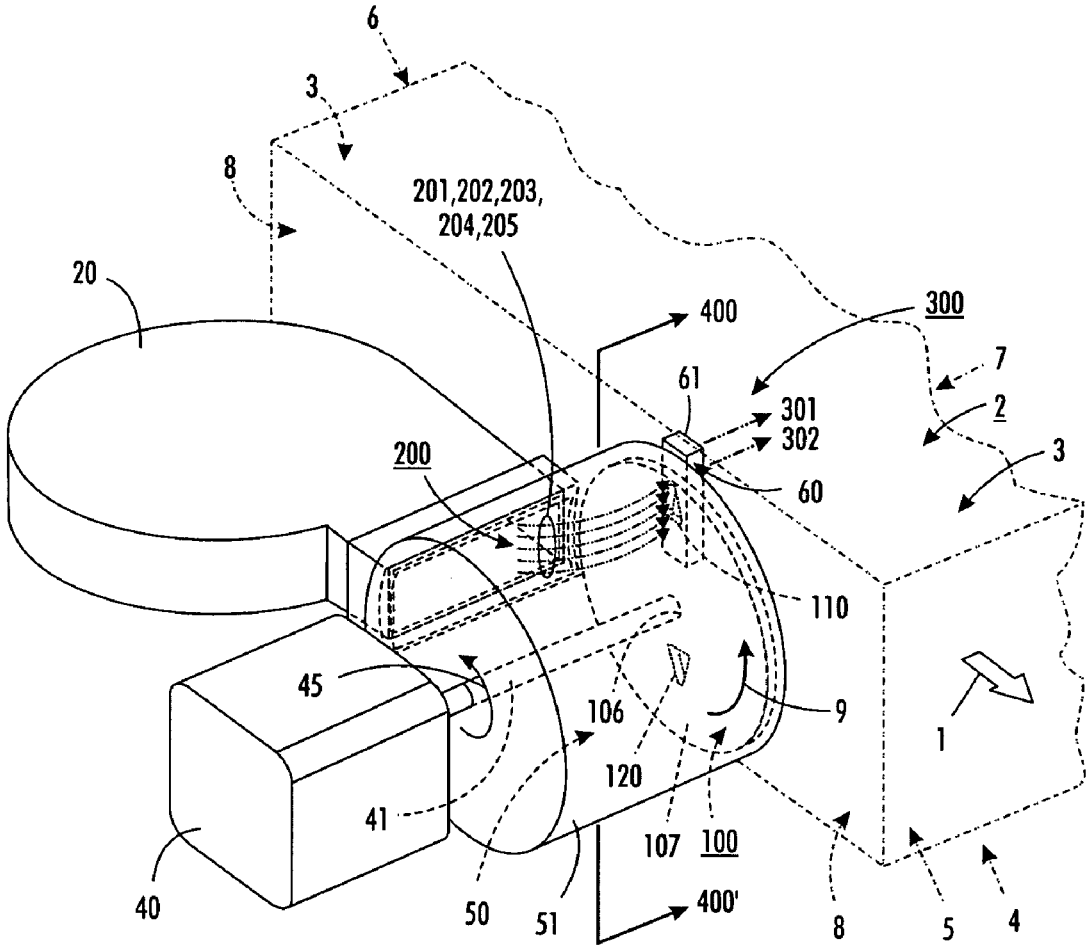
FIG. 1 shows a media stack sheet fluffer means 10 arranged to fluff media sheets comprised in a media stack 2. A movable aperture plate 100 contains one or more fluffer apertures disposed in a pattern. A first fluffer aperture pattern comprises two apertures 110 and 120. Also shown is a reference line 400-400'.

FIG. 1 shows a media stack sheet fluffer means 10 arranged to fluff a media stack 2. Also shown is the downstream or media process direction or path 1. As shown, the media stack 2 comprises a media stack tap edge or surface 3, a media stack bottom edge or surface 4, a media stack leading edge, surface or side 5, a media stack trailing edge, surface or side 6, a media stack inboard edge, surface or side 7 and a media stack outboard edge, surface or side 8. The fluffer means 10 comprises a plenum air flow means 20 to provide a plenum flow 200, 201-205 to a plenum 50. A movable aperture plate 100 having a width 108 comprising one or more fluffer apertures arranged in a fluffer aperture pattern is situated between the plenum flow and an adjacent fluffer jet 60.

In one embodiment, the plenum air flow means 20 comprises a source of pressurized air such as, for example, a pressurized air blower.

As shown, a first fluffer aperture pattern comprises two (2) individual apertures 110 and 120 as shown. As the aperture plate rotates 9 about the aperture plate axis 106, each individual aperture (110 or 120) is momentarily presented to the fluffer jet 60, thus allowing the plenum flow 200 to momentarily pass through the aperture (110 or 120) to enter the fluffer jet 60, thus forming a momentary media stack fluffer jet flow 300. The fluffer jet 60, in turn, provides the momentary media stack fluffer jet flow 300 to any one or more of the media stack sides 5, 6, 7, 8 comprised in the media stack 2 such as, for example, the depicted media stack outboard edge, surface or side 8.

Referring to FIG. 1, in various embodiments the fluffer aperture pattern comprises plural fluffer apertures where all fluffer apertures have the substantially same and identical size, dimension and cross-sectional area.

Also, in various embodiments the fluffer aperture pattern comprises plural fluffer apertures where at least one fluffer aperture has a substantially different and non-identical size, dimension and cross-sectional area.

Still referring to FIG. 1, in various embodiments the fluffer aperture pattern comprises plural fluffer apertures where all fluffer apertures have the substantially same and identical geometric shape.

Also, in various embodiments the fluffer aperture pattern comprises plural fluffer apertures where at least one fluffer aperture has a substantially different and non-identical geometric shape.

Referring still to FIG. 1, in various embodiments the fluffer aperture pattern comprises plural fluffer apertures whew all fluffer apertures are disposed at the substantially same and identical radial distance from an included aperture plate axis 106, thus resulting in providing the media stack fluffer jet flow 300 at a generally fixed position with respect to the media stack sheets.

Also, in various embodiments the fluffer aperture pattern comprises plural fluffer apertures where at least one fluffer aperture is disposed at a substantially different and non-identical radial distance from the aperture plate axis 106.

Still referring to FIG. 1, in various embodiments the media stack sheet fluffer means 10 is arranged to provide the media stack fluffer jet flow 300 to the media stack outboard edge, surface or side 8.

Also, in various embodiments the media stack sheet fluffer means 10 is arranged to provide the media stack fluffer jet flow 300 to the media stack inboard edge, surface or side 7.

Also, in various embodiments the media stack sheet fluffer means 10 is arranged to provide the media stack fluffer jet flow 300 to the media stack leading edge, surface or side 5.

Also, in various embodiments the media stack sheet fluffer means 10 is arranged to provide the media stack fluffer jet flow 300 to the media stack trailing edge, surface or side 6.

Also, in various embodiments the media stack sheet fluffer means 10 is arranged to provide the media stack fluffer jet flow 300 to any one or more of the four media stack edges, surfaces or sides 5, 6, 7, 8 in the media stack 2.

For example, in various embodiments the media stack sheet fluffer means 10 is arranged to provide a plurality (N) of media stack fluffer jet flows 300 to only one (1) and thus the identical or same media stack edge, surface or side of the media stack leading edge, surface or side 5, the media stack trailing edge, surface or side 6, the media stack inboard edge, surface or side 7 and the media stack outboard edge, surface or side 8.

Also shown in FIG. 1 is a reference line 400-400' which is parallel to the aperture plate surface 107 and aligned with the aperture plate axis 106.

Figure 2:
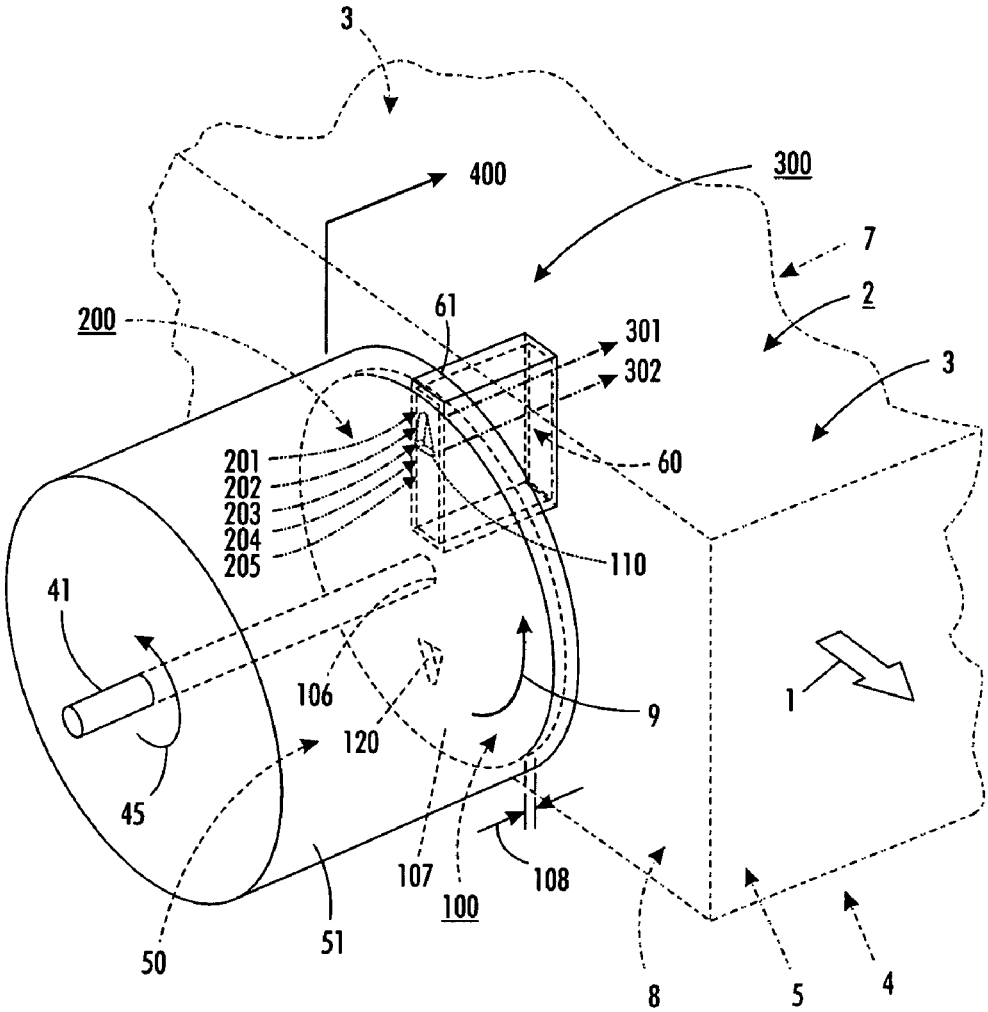
FIG. 2 is a further view of the media stack sheet fluffer means 10 of FIG. 1.

FIG. 2 is a further view of the media stack sheet fluffer means 10 of FIG. 1 including the aperture plate 100. As shown, when the aperture plate 100 is positioned such that the "upper" aperture 110 is momentarily presented to the fluffer jet 60, the fluffer jet 60 provides the resulting upper momentary media stack fluffer jet flows 301-302 to the media stack outboard edges or sides 8 of corresponding "upper" media sheets that are situated at or near the media stack top 3.

Figure 3:
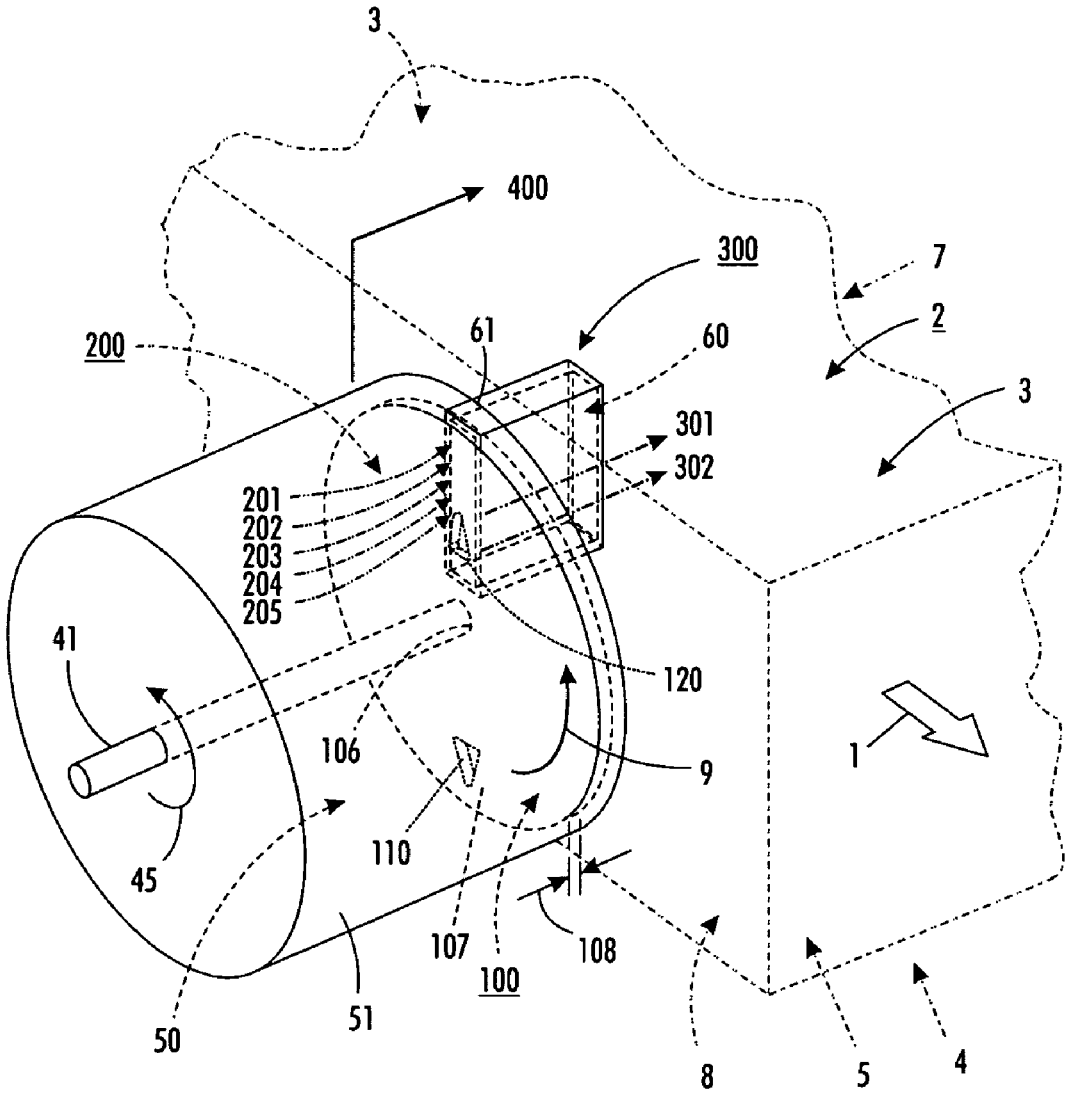
FIG. 3 is a further view of the media stack sheet fluffer means 10 of FIG. 1.

FIG. 3 is a further view of the media stack sheet fluffer means 10 of FIG. 1 wherein the aperture plate 100 has rotated in the direction 9 such that the "lower" aperture 120 is momentarily presented to the fluffer jet 60. In turn, the fluffer jet 60 provides the resulting lower momentary media stack fluffer jet flows 304-305 to the media stack outboard edges or sides 8 of corresponding "lower" media sheets that situated beneath or "lower" than the media stack top 3.

Referring now generally to FIGS. 2-3, by comparing the upper aperture 110 and the lower aperture 120 it is seen that the upper aperture 110 is fixed at a relatively greater, maximum or "upper" radial distance from the aperture plate axis 106, thus resulting in the corresponding "upper" momentary media stack fluffer jet flows 301-302 being provided to the media stack outboard edges or sides 8 of corresponding "upper" media sheets that are situated at or near the media stack top 3. In contrast, it further is seen that the lower aperture 120 is fixed at a relatively lesser, minimum or "lower" radial distance from the aperture plate axis 106, thus resulting in the corresponding relatively "lower" momentary media stack fluffer jet flows 304-305 being provided to the media stack outboard edges or sides 8 of corresponding relatively "lower" media sheets that are situated relatively "lower" than the media stack top 3.

Figure 4:
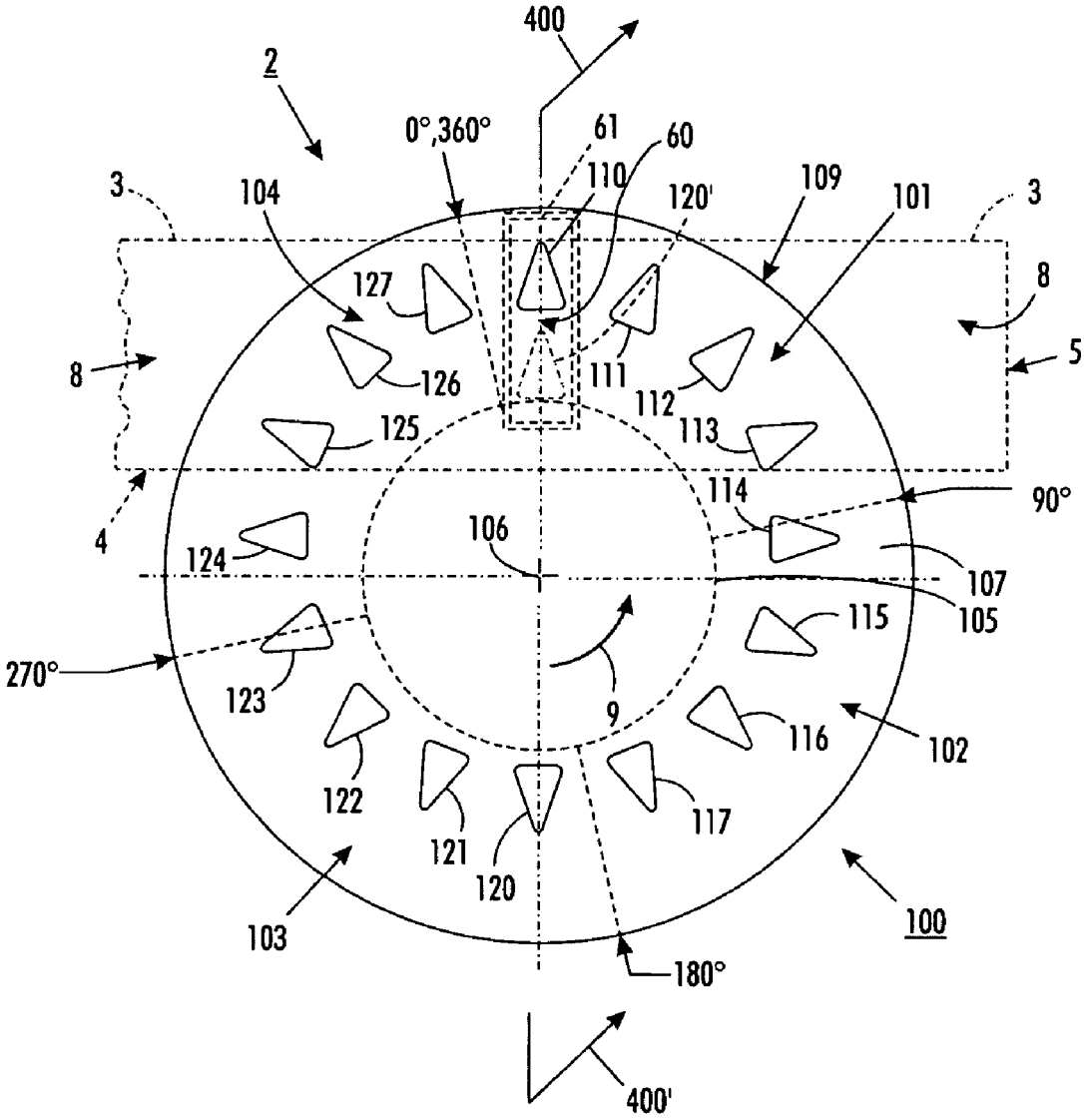
FIG. 4 depicts a second fluffer aperture pattern in connection with the aperture plate 100 of FIGS. 1-3.

FIG. 4 depicts a second fluffer aperture pattern in connection with the aperture plate 100 of the media stack sheet fluffer means 10 of FIG. 1. As shown, FIG. 4 depicts a top-down "bird's eye" view of the aperture plate 100 along the reference line 400-400'. Also shown in broken lines is the media stack 2, the media stack top 3, the media stack bottom 4, the media stack leading edge, surface or side 5, the media stack outboard edge, surface or side 8, the fluffer jet 60 and the fluffer jet housing 61. As shown, in one embodiment the aperture plate 100 is a circular-shaped plate which, for illustrative purposes, is divided into a first aperture plate region 101 from zero (0) to ninety (90) degrees, a second aperture plate region 102 from ninety (90) to one-hundred-eighty (180) degrees, a third aperture plate region 103 from one-hundred-eighty (180) to two-hundred-seventy (270) degrees and a fourth aperture plate region 104 from two-hundred-seventy (270) to three-hundred-sixty (360) or zero (0) degrees.

Still referring to FIG. 4, the second fluffer aperture pattern includes the upper aperture 110 of FIGS. 1-3 together with a plurality of descending apertures respectively depicted as 111, 112, 113, 114, 115, 116, 117 disposed in aperture plate regions 101 and 102 as shown. The upper aperture 110 is disposed in the aperture plate 100 at the maximum or "uppermost" radial distance from the plate axis 106, while each of the successive apertures 111 through 117 is fixed at a corresponding monotonically decreasing or "descending" radial distance from the plate axis 106. Thus, when the upper aperture 110 is momentarily presented to the fluffer jet 60, a corresponding momentary media stack fluffer jet flow 300 301-302 is provided to the uppermost sheets of the media stack 2. Further, when each of the successive descending apertures 111 through 157 is momentarily presented to the fluffer jet 60, a corresponding momentary media stack fluffer jet flow 300 is provided to successively lower sheets of the media stack 2. Hence, as the aperture plate 100 moves in direction 9, each of the series of individual apertures 110, 111, 112, 113, 114, 115, 116, 117 and 120 is successively momentarily presented to the fluffer jet 60 which, in turn, enables the plenum flow 200 to provide a corresponding series of monotonically lowering or descending individual momentary media stack fluffer jet flows 300 to the outboard edges or sides 8 of corresponding media sheets in the media stack 2.

Referring still to FIG. 4, the second fluffer aperture pattern further includes the lower aperture 120 of FIGS. 1-3 together with a plurality of ascending apertures respectively depicted as 121, 122, 123, 124, 125, 126, 127 disposed in aperture plate regions 103 and 104 as shown. The lower aperture 120 is disposed in the aperture plate 100 at the minimum or "lowermost" radial distance from the plate axis 106, while each of the successive apertures 121 through 127 is fixed at a corresponding monotonically increasing or "ascending" radial distance from the plate axis 106. Thus, when the lower aperture 120 is momentarily presented to the fluffer jet 68, a corresponding momentary media stack fluffer jet flow 300, 301-305 is provided to the lowermost of those media sheets that are fluffed by the media stack sheet fluffer means 10 of FIG. 1. Further, when each of the successive ascending apertures 121 through 127 is momentarily presented to the fluffer jet 60, a corresponding momentary media stack fluffer jet flow 300 is provided to successively upper sheets of the media stack 2. Hence, as the aperture plate 100 moves in direction 9, each of the series of individual apertures 120, 121, 122, 123, 124, 125, 126, 127 and 110 is successively momentarily presented to the fluffer jet 60 which, in turn, enables the plenum flow 200 to provide a corresponding series of monotonically rising or ascending individual momentary media stack fluffer jet flows 300 to the outboard edges or sides 8 of corresponding media sheets in the media stack 2.

Figure 5:
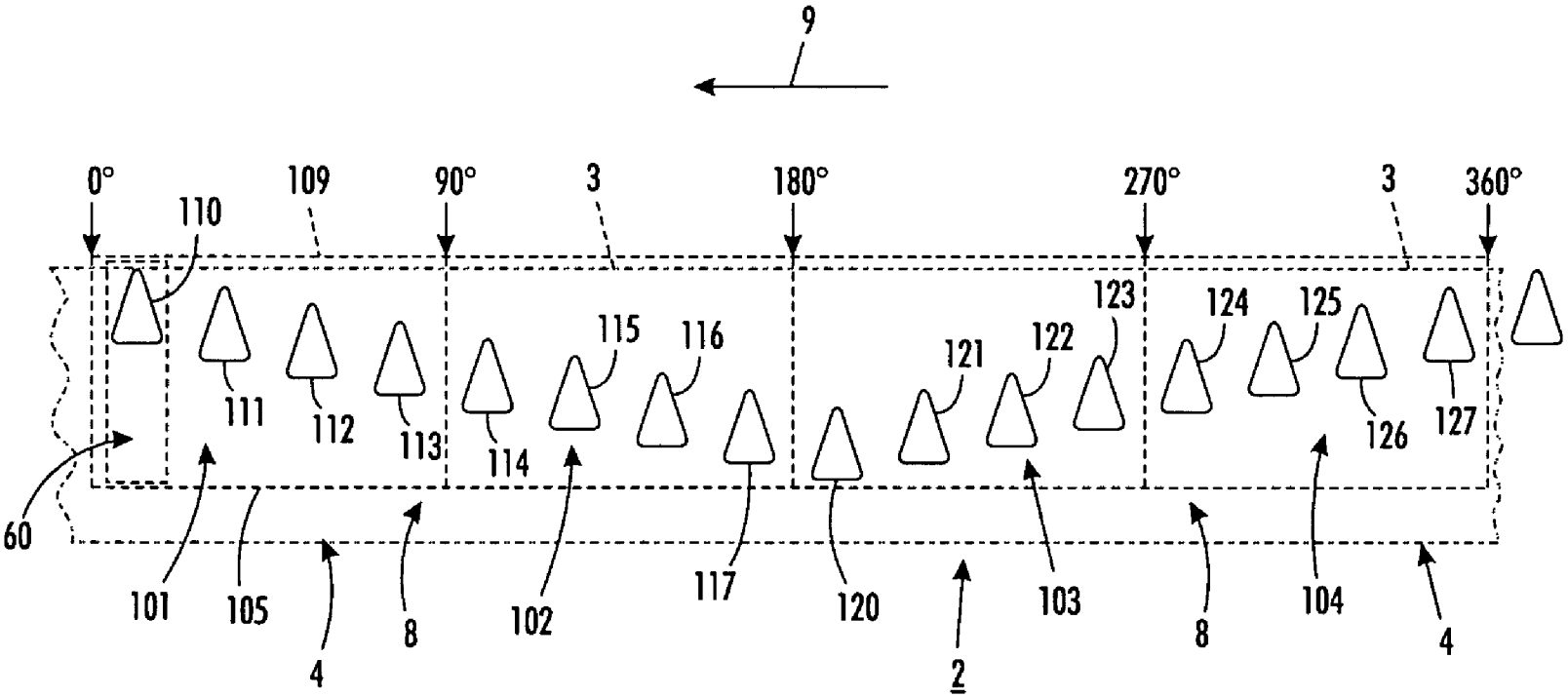
FIG. 5 is a further view of the second fluffer aperture pattern of FIG. 4.

Referring now to FIG. 5, there is a further view of the second fluffer aperture pattern of FIG. 4. Also shown in broken lines is the media stack 2, the media stack top 3, the media stack bottom 4, the media stack outboard edge, surface or side 8 and the fluffer jet 60. As described in connection with FIG. 4 above, as the aperture plate 100 moves in the direction 9, each of the series of successively descending apertures 110, 111, 112, 113, 114, 115, 116, 117 and 120 is momentarily presented to the fluffer jet 60, thus resulting in a corresponding series of successively descending momentary media stack fluffer jet flows 300 being provided to the outboard edges or sides 8 of a corresponding series of successively descending or lowering media sheets of the media stack 2. Thereafter, as the aperture plate 100 continues moving in the direction 9, each of the series of successively ascending apertures 120, 121, 122, 123, 124, 125, 126, 127 and 110 is momentarily presented to the fluffer jet 60, thus resulting in a corresponding series of successively ascending momentary media stack fluffer jet flows 300 being provided to the outboard edges or sides 8 of a corresponding series of successively ascending or rising media sheets of the media stack 2.

Figure 6:
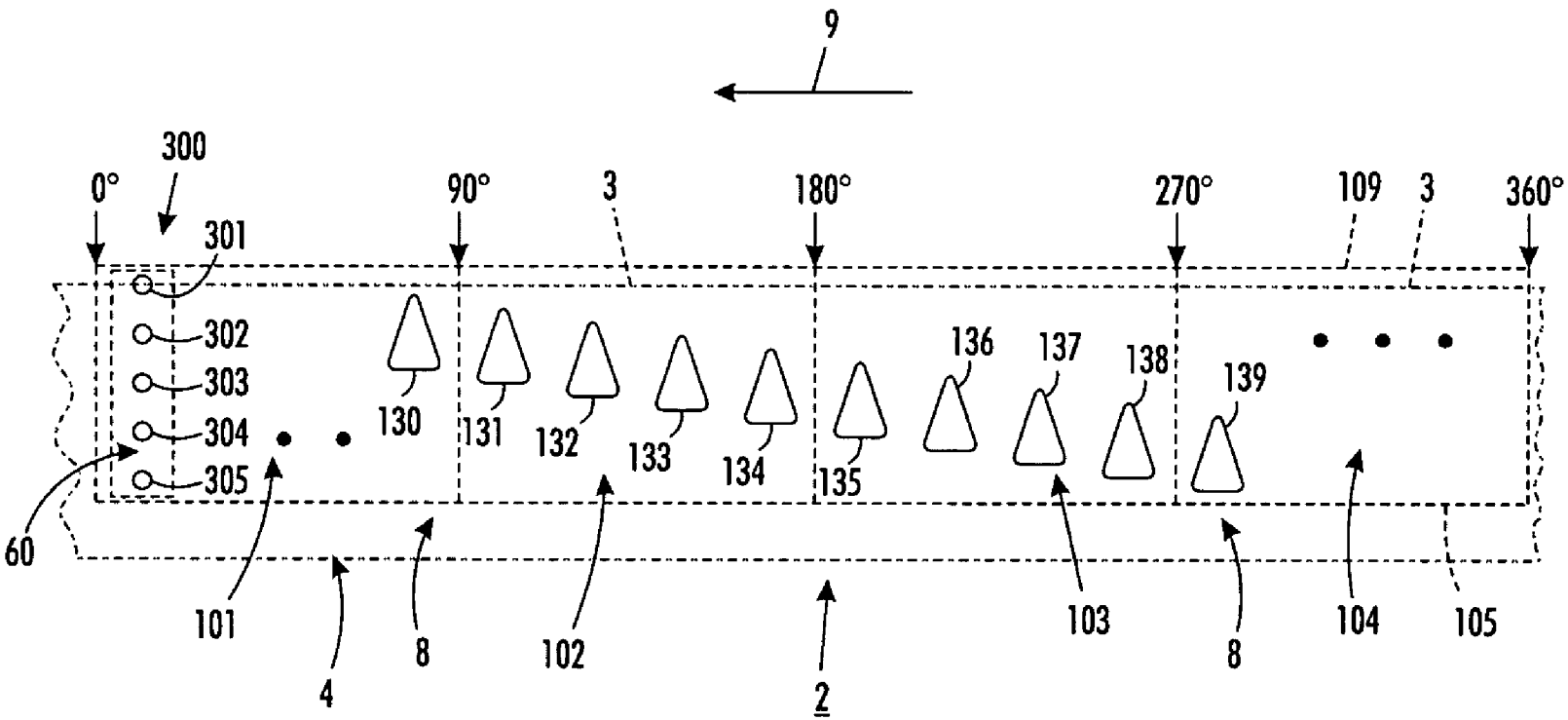
FIG. 6 depicts a third fluffer aperture pattern in connection with the aperture plate 100 of FIGS. 1-3.

Referring now to FIG. 6, there is depicted a third fluffer aperture pattern in connection with the aperture plate 100 of the media stack sheet fluffer means 10 of FIG. 1. Also shown in broken lines is the media stack 2, the media stack top 3, the media stack bottom 4, the media stack outboard edge, surface or side 8 and the fluffer jet 60. As shown, the third fluffer aperture pattern includes a series of successively descending apertures respectively depicted as 130, 131, 132, 133, 134, 135, 136, 137, 138 and 139 disposed in aperture plate regions 101, 102, 103 and 104 as shown. Similar to the description of the series of successively descending apertures 110, 111, 112, 113, 114, 115, 116, 117 and 120 in connection with FIG. 5 above, as the aperture plate 100 moves in the direction 9, each of the series of successively descending apertures 130, 131, 132, 133, 134, 135, 136, 137, 138 and 139 is momentarily presented to the fluffer jet 60, thus resulting in a corresponding series of successively descending momentary media stack fluffer jet flows 300 being provided to the outboard edges or sides 8 of a corresponding series of successively descending or lowering media sheets of the media stack 2.

Figure 7:
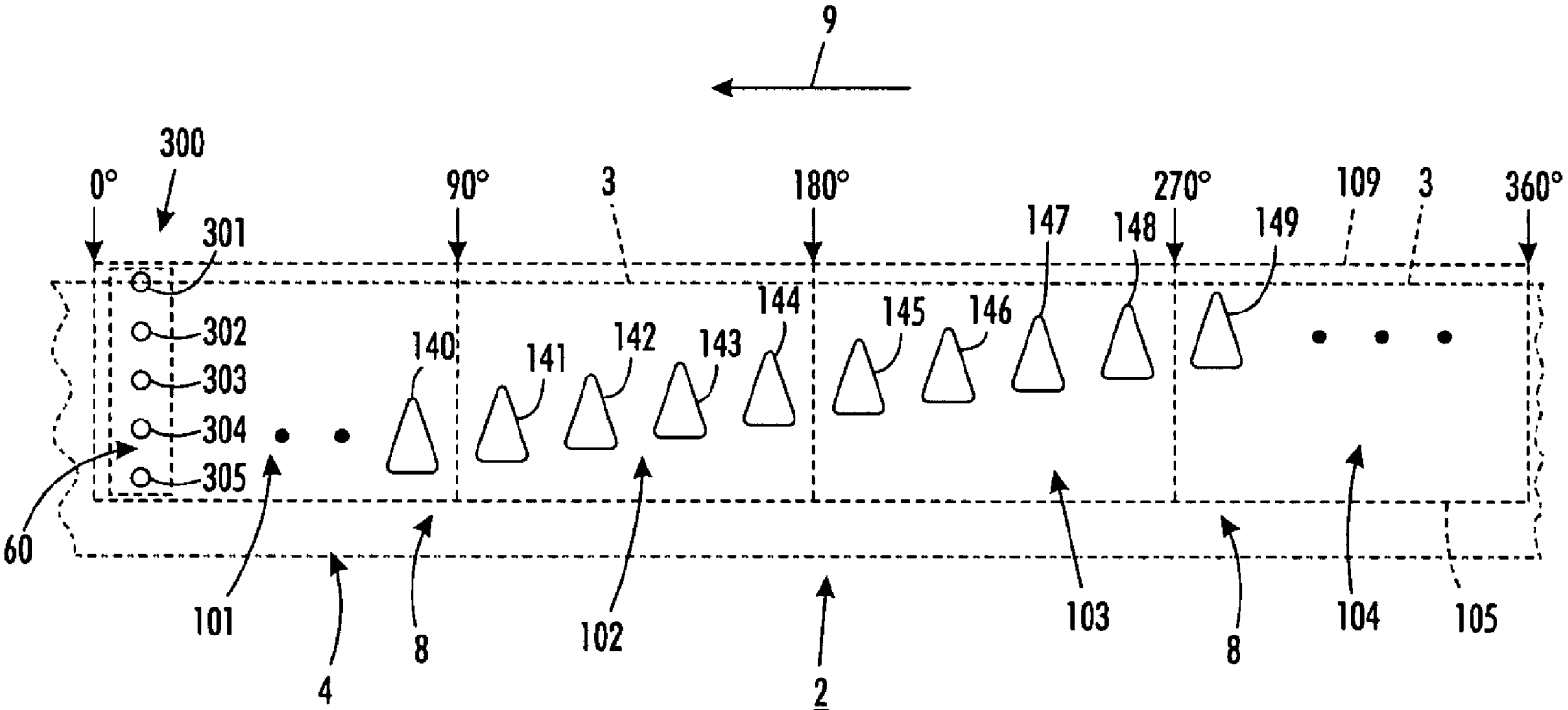
FIG. 7 depicts a fourth fluffer aperture pattern in connection with the aperture plate 100 of FIGS. 1-3.

Referring now to FIG. 7, there is depicted a fourth fluffer aperture pattern in connection with the aperture plate 100 of the media stack sheet fluffer means 10 of FIG. 1. Also shown in broken lines is the media stack 2, the media stack top 3, the media stack bottom 4, the media stack outboard edge, surface or side 8 and the fluffer jet 60. As shown, the fourth fluffer aperture pattern includes a series of successively ascending apertures respectively depicted as 140, 141, 142, 143, 144, 145, 146, 147, 148 and 149 disposed In aperture plate regions 101, 102, 103 and 104 as shown. Similar to the description of the series of successively ascending apertures 120, 121, 122, 123, 124, 125, 126, 127 and 110 in connection with FIG. 5 above, as the aperture plate 300 moves in the direction 9, each of the series of successively ascending apertures 140, 141, 142, 143, 144, 145, 146, 147, 148 and 149 is momentarily presented to the fluffer jet 60, thus resulting in a corresponding series of successively ascending momentary media stack fluffer jet flows 300 being provided to the outboard edges or sides 8 of a corresponding series of successively ascending or rising media sheets of the media stack 2.

Figure 8:
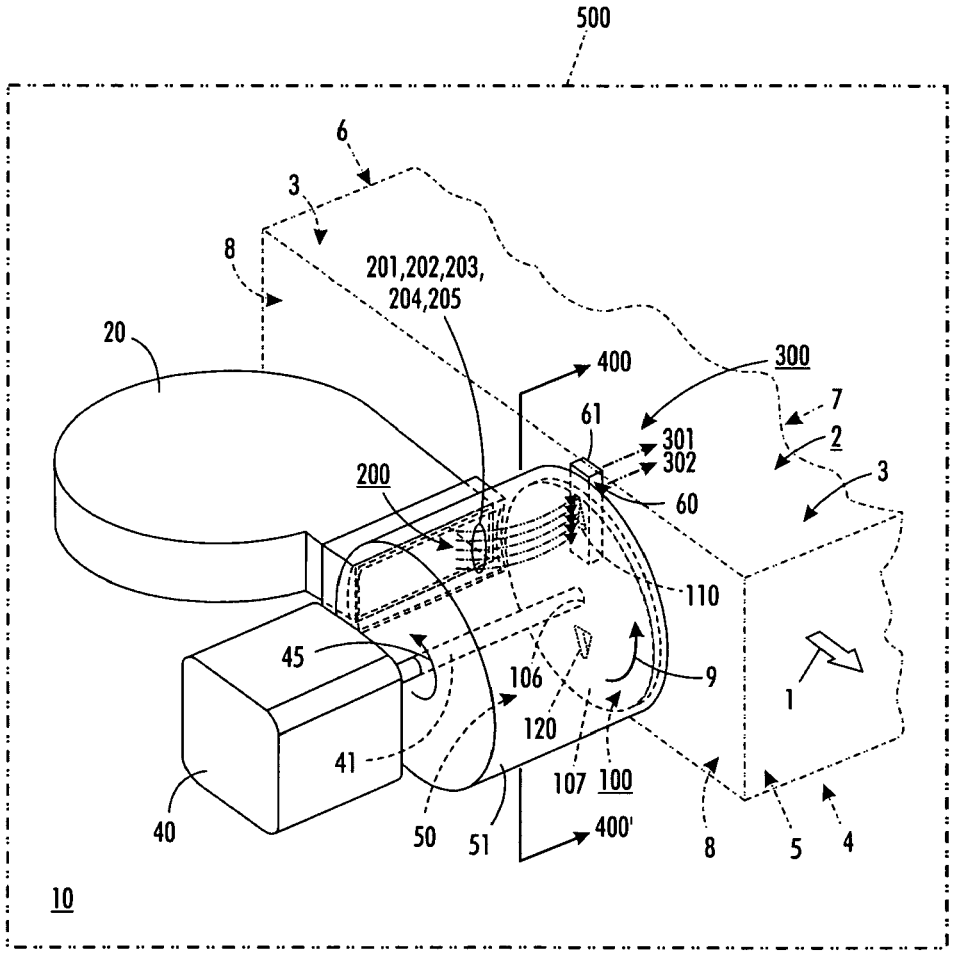
FIG. 8 shows a media processing device 500 arranged with the media stack sheet fluffer means 10 of FIG. 1.

FIG. 8 shows a media processing device 500 arranged with the media stack sheet fluffer means 10 of FIG. 1. In one embodiment, the media processing device 500 comprises an image forming device 500 such as, for example, any of a printing machine, a copying machine, a marking device and a facsimile machine. In another embodiment, the media processing device comprises a media sheet feeder.

In summary, as described herein, rather than a continuous stream of fluffing air to separate stacked sheets, a rapidly pulsed media stack fluffer jet flow 300 is used. Pressurized air exiting a plenum 50 having a side 51 adjacent to the media stack 2 through a fluffer jet port 60 facing the media stack 2 are rapidly turned on and off by means of a stepper-motor-40-controlled rotary gate-aperture plate 100 to produce an agitated flow of air 300 into the media stack 2, thereby increasing the efficiency of separation. Frequency, volume, and location of the flow 300 are customized through rotary gate-aperture plate 100 design and stepper motor 40 speed to achieve best results for varying media type, weight, and environmental factors. As described herein in connection with the drawing, the rotary gate-aperture plate 100 fluffer apertures controlled by the stepper motor 40 are rapidly opened and closed to pulse air exiting the plenum 50 into the paper supply 2. The speed of the rotary gate-aperture plate 100 can be varied. media stack fluffer jet flow 300 volume is controlled by means of the rotary gate-aperture plate 100 geometry. Possibilities include each fluffer aperture port having the same cross-sectional area, varying area, varying center of fluffer aperture ports up or down, and various combinations of these options.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A media stack sheet fluffer method, comprising:

providing a plenum flow to an aperture plate that includes plural apertures;

repetitively positioning the aperture plate to present a sequence of individual apertures to a fluffer jet, thereby forming a sequence of momentary jet flows to form a media stack fluffer jet flow; and providing the media stack fluffer jet flow to a plurality of media stack sheets.

2. The media stack sheet fluffer method of claim 1, wherein the media stack fluffer jet flow is provided at a generally fixed position with respect to the plurality of media stack sheets.

3. The media stack sheet fluffer method of claim 1, wherein a first momentary jet flow is provided to a first plurality of media stack sheets and then providing a second momentary jet flow to a second plurality of media stack sheets which sheets are positioned either above or below the first plurality of media stack sheets.

4. The media stack sheet fluffer method of claim 1, wherein a first momentary jet flow is provided at a first position at or near an included media stack top and a second momentary jet flow is provided at a second position that is lower than the first position.

5. The media stack sheet fluffer method of claim 1, wherein a momentary jet flow is provided at each of a sequence of descending positions with respect to the media stack sheets.

6. The media stack sheet fluffer method of claim 1, wherein a momentary jet flow is provided at each of a sequence of ascending positions with respect to the media stack sheets.

7. The media stack sheet fluffer method of claim 1, wherein a momentary jet flow is repetitively provided at each of a sequence of predetermined positions with respect to the media stack sheets.

8. The media stack sheet fluffer method of claim 1, wherein the aperture plate is repetitively positioned to present the sequence of individual apertures to the fluffer jet using a stepper motor.

9. A media processing device, comprising:

media stack sheet fluffer means providing a plenum flow to an aperture plate that includes plural apertures, repetitively positioning the aperture plate to present a sequence of individual apertures to a fluffer jet, thereby forming a sequence of momentary jet flows to form a media stack fluffer jet flow and providing the media stack fluffer jet flow to a plurality of media stack sheets.

10. The media processing device of claim 9, wherein the media processing device is an image forming device including any of a printing machine, copying machine, marking device and facsimile machine.

11. The media processing device of claim 9, further comprising a media sheet feeder.

12. The media processing device of claim 9, wherein the media stack fluffer jet flow is provided at a generally fixed position with respect to the plurality of media stack sheets.

13. The media processing device of claim 9, wherein a first momentary jet flow is provided to a first plurality of media stack sheets and then providing a second momentary jet flow to a second plurality of media stack sheets which sheets are positioned either above or below the first plurality of media stack sheets.

14. The media processing device of claim 9, wherein a first momentary jet flow is provided at a first position at or near an included media stack top and a second momentary jet flow is provided at a second position that is lower than the first position.

15. The media processing device of claim 9, wherein a momentary jet flow is provided at each of a sequence of descending positions with respect to the media stack sheets.

16. The media processing device of claim 9, wherein a momentary jet flow is provided at each of a sequence of ascending positions with respect to the media stack sheets.

17. The media processing device of claim 9, wherein a momentary jet flow is repetitively provided at each of a sequence of predetermined positions with respect to the media stack sheets.

18. The media processing device of claim 9, wherein the aperture plate is repetitively positioned to present the sequence of individual apertures to the fluffer jet using a stepper motor.

19. A media stack sheet fluffer method, comprising:

providing a plenum flow to an aperture plate that includes plural apertures, each aperture disposed at a corresponding radial distance from the aperture plate's axis;

rotating the aperture plate about the aperture plate's axis to present a first aperture to a fluffer jet, thereby forming a first media stack fluffer jet flow;

providing the resulting first media stack fluffer jet flow to sheet edges in a media stack side of an included media stack;

rotating the aperture plate about the aperture plate's axis to present a second aperture to the fluffer jet, thus forming a second media stack fluffer jet flow; and providing the second media stack fluffer jet flow to sheet edges in the media stack side, where the first aperture is disposed at a first radial distance from the aperture plate's axis and the second aperture is disposed at a second radial distance from the aperture plate's axis and the first radial distance is not equal to the second radial distance.

20. The media stack sheet fluffer method of claim 19, wherein the aperture plate is rotated using a stepper motor.

* * * * *